US005192162A

United States Patent [19]

McKinnon

[11] Patent Number: 5,192,162

[45] Date of Patent: Mar. 9, 1993

[54] POOL APPARATUS AND METHOD OF MAKING

[76] Inventor: Gordon McKinnon, 119 South Oregon Ave., Tampa, Fla. 33606

[21] Appl. No.: 790,649

[22] Filed: Nov. 8, 1991

[51] Int. Cl.[5] ..... E04H 3/16; E04H 3/18

[52] U.S. Cl. ..... 405/55; 4/506; 52/169.7

[58] Field of Search ..... 405/53, 55; 4/488, 506, 4/513; 52/169.7, 742, 2.15; 264/31

[56] References Cited

U.S. PATENT DOCUMENTS

| | | | |
|---|---|---|---|
| 1,952,481 | 3/1934 | Westberg . | |
| 2,187,224 | 1/1940 | Cory | 264/31 |
| 2,887,759 | 5/1959 | Brownell, Jr. | 52/169.7 X |
| 3,015,191 | 1/1962 | Lucchesi | 52/169.7 |
| 3,024,470 | 3/1962 | Baker | 52/169.7 |
| 3,031,801 | 5/1962 | Leuthesser | 52/169.7 X |
| 3,069,695 | 12/1962 | Hegerfeld | 52/169.7 |
| 3,177,501 | 4/1965 | Kwake | 52/169.7 |
| 3,231,902 | 2/1966 | Racina | 52/169.7 |
| 3,419,916 | 1/1969 | Schankler | 52/169.7 |
| 3,429,085 | 2/1969 | Stillman, Jr. | 52/169.7 |
| 3,440,780 | 4/1969 | Adam et al. | 52/169.8 X |
| 3,468,088 | 9/1969 | Miller | 52/169.7 X |
| 3,487,599 | 1/1970 | Jansen | 52/169.7 |
| 3,511,002 | 5/1970 | Fox | 52/169.8 X |
| 3,568,392 | 3/1971 | Stark | 52/169.7 X |
| 3,585,655 | 6/1971 | Lankheet | 52/169.7 X |
| 3,823,690 | 7/1974 | Rynberk | 52/169.7 X |
| 3,930,346 | 1/1976 | Blakeway | 52/169.7 |
| 3,975,782 | 8/1976 | Lankheet | 52/169.7 |
| 4,090,266 | 5/1978 | Price | 52/169.7 |
| 4,125,983 | 11/1978 | Jarrell | 52/169.7 X |
| 4,170,093 | 10/1979 | Cappellini et al. | 52/21.5 X |
| 4,207,017 | 6/1980 | Jarrell | 52/169.7 X |
| 4,263,759 | 4/1981 | Miller | 52/169.7 |
| 4,306,394 | 12/1981 | Blakeway | 52/169.7 |
| 4,343,118 | 8/1982 | Lankheet | 52/169.7 |
| 4,409,772 | 10/1983 | Boyack | 52/746 |
| 4,656,796 | 4/1987 | DePorcellinis | 52/169.7 |
| 4,756,033 | 7/1988 | Schelfhorst | 4/506 |
| 4,948,296 | 8/1990 | Salter | 405/55 |

*Primary Examiner*—Randolph A. Reese
*Assistant Examiner*—John Ricci
*Attorney, Agent, or Firm*—Frijouf, Rust & Pyle

[57] ABSTRACT

An apparatus and method is disclosed for an improved swimming pool comprising a base forming the bottom of the pool. A plurality of upright supports are disposed about the base with a side wall sheet being affixed to the plurality of upright supports. The side wall sheet has an inner surface and an outer surface. An inner coating is disposed on the inner surface and is disposed on the base for affixing the side wall sheet to the base and for forming an interior surface for the pool. An outer coating is disposed on the outer surface for affixing the side wall sheet to the plurality of upright supports.

18 Claims, 8 Drawing Sheets

POOL APPARATUS AND METHOD OF MAKING

BACKGROUND OF THE INVENTION

1. Field of the Invention

This invention relates to swimming pools and the like and more particularly to an improved apparatus and method of rapidly making a swimming pool from readily transportable component materials.

2. Background of the Invention

With the advent of more leisure time, the popularity of swimming pools has increased substantially in the last several decades. In general, swimming pools may be constructed as an in ground pool or as an above ground pools. In an in ground pool, soil is excavated from the pool site and a hardenable material such as a cementitious material is applied to form the bottom and sidewalls of the swimming pool. Examples of in-ground pools are illustrated in U.S. Pat. No. 2,887,759; U.S. Pat. No. 3,015,191 and U.S. Pat. No. 3,568,392. In a typical above ground pool, the pool site may be excavated and a retaining wall is erected around the perimeter of the excavated pool. A pool liner generally made of a flexible sheet plastic material is affixed to the peripheral wall to cover the excavated hole thus making the pool water tight. An example of an above ground pool is set forth in U.S. Pat. No. 3,177,501.

Above ground pools are generally less expensive than an in ground pool since the hardenable material forming the bottom and sidewalls of the in ground pool is replaced by a sheet plastic liner. Unfortunately, the vinyl liner of an above-ground pool does not provide the durability since the thin vinyl liner may be cut by a sharp object. Furthermore, the pool liners must be preformed of a particular size or must be fabricated at site thus limiting the shape and size of the swimming pool.

In an effort to reduce the cost of in ground pools, some in the prior art have utilized a plurality of ridged side wall panels for forming the side walls of the in ground pool. U.S. Pat. No. 3,440,780; U.S. Pat. No. 3,468,088; U.S. Pat. No. 3,511,002 and U.S. Pat. No. 3,585,655 illustrate various ridged side wall panels for constructing the side walls of an in ground swimming pool.

Others in the prior art have attempted to use a rolled sheet material for fabricating the side wall of a swimming pool. U.S. Pat. No. 3,031,801; U.S. Pat. No. 3,930,346; U.S. Pat. No. 4,125,983; U.S. Pat. No. 4,263,759; U.S. Pat. No. 4,207,017 and U.S. Pat. No. 4,656,796 illustrate swimming pools having a side wall formed from a rolled sheet material. The rolled sheet material was sometimes affixed to the bottom of a cementitious pool base by mechanical means such as shown in U.S. Pat. No. 3,975,782.

Thereafter, the side wall and the bottom of the pool was covered by an external coating such as fiberglass or the like. U.S. Pat. No. 3,429,085; U.S. Pat. No. 3,823,690; U.S. Pat. No. 4,207,017; U.S. Pat. No. 4,409,772 and U.S. Pat. No. 4,948,296 all illustrate various external coatings for swimming pools.

Although the aforementioned prior art has contributed substantially to the reduction in cost of construction of swimming pools, the aforementioned prior art has certain disadvantages over a conventional cementitious in ground swimming pool. First, many of the in ground pools having a plurality of ridged side wall panels had to be constructed in a specific size and shape thus limiting the size and shape of the completed swimming pool. Second, many of the swimming pools and construction techniques utilizing rolled material lacked the proper mechanical strength and sealing properties equivalent to a cementitious in ground swimming pool. Third, the external coating applied to the side walls of the swimming pools did not properly adhere to the side wall material thus enhancing the possibility of the delamination of the external coating from the sidewall material. Such a delamination is totally unsatisfactory to a purchaser making a substantial investment of a swimming pool. Fourth, the use of a plurality of ridged side wall panels or the use of the rolled sidewall materials were incapable of providing entrance steps for the pool. Accordingly the entrance steps for the pool were required to be manufactured in an conventional manner.

Therefore it is an object of this invention to provide an improved swimming pool apparatus which overcomes the deficiencies of the prior art devices and provides a new apparatus and method of making a swimming pool of lower cost with the reliability and durability commensurate with a cementitious pool.

Another object of this invention is to provide an improved swimming pool apparatus which is capable of being constructing either as in ground pool or as an above ground pool.

Another object of this invention is to provide a swimming pool apparatus wherein the materials of construction do not limited the size or shape of the swimming pools.

Another object of this invention is to provide an improved swimming pool apparatus wherein the sidewalls are mechanically reinforced through an external coating to provide a mechanical strength equivalent to a cementitious pool.

Another object of this invention is to provide an improved swimming pool apparatus wherein the sidewall may be mechanically bonded to a cementitious base through the use of a web and an external coating.

Another object of this invention is to provide an improved swimming pool apparatus incorporating means for mechanically affixing an external coating to the sidewalls for reducing the possibility of delamination of the external coating from the sidewall.

Another object of this invention is to provide an improved swimming pool apparatus which is capable of fabricating entrance steps within the swimming pool.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved swimming pool apparatus, comprising a base extending within a peripheral edge with said base being contoured to form the bottom of the pool. A plurality of upright supports are disposed adjacent said peripheral edge of said cementitious base with a side wall sheet extending about said peripheral edge of said base. The side wall sheet is disposed between said peripheral edge of said base and said plurality of upright supports and is affixed to said plurality of upright supports. An inner coating is disposed on said inner surface of said side wall sheet and disposed on said base for affixing said side wall sheet to said base and for forming an interior surface for the pool. An outer coating is disposed on said outer surface of said side wall sheet for affixing said side wall sheet to said plurality of upright supports.

In a more specific embodiment of the invention, the base comprises a cementitious material supported by ground soil with the plurality of upright supports extending into the ground soil. Preferably, the side wall sheet comprises a sheet of flexible plastic material with the sheet of plastic material comprising an inner sheet and an outer sheet with a plurality of parallel interconnecting sheet elements securing said inner sheet to said outer sheet for enabling said sheet of flexible plastic material to flex in a horizontal direction and for inhibiting said sheet of flexible plastic material to flex in a vertical direction. In one embodiment of the invention, the means for affixing said side wall sheet to said plurality of upright supports includes fastening means extending through a plurality of apertures defined in said side wall sheet.

Preferably, the inner coating and said outer coating comprises a coating of fiberglass with a plurality of apertures defined in said side wall sheet. The inner coating of fiberglass and said outer coating of fiberglass are joined to another through said plurality of apertures for mechanically securing said inner coating of fiberglass to said side wall sheet.

The invention is also incorporated into the method of making an in ground swimming pool, comprising the steps of excavating a hole in the ground in the shape and the depth of the desired pool. A plurality of upright supports are installed into the ground about the periphery of the excavated hole. A side wall sheet is affixed to the plurality of upright supports for defining the sidewall of the pool. A cementitious base is poured within the side wall sheet to form the bottom of the pool. A fiberglass coating is applied on an inner surface of the side wall sheet and is applied on the cementitious base for affixing the side wall sheet to the cementitious base and for forming an interior surface for the pool. A fiberglass coating is applied on an outer surface of the side wall sheet for affixing the side wall sheet to the plurality of upright supports.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
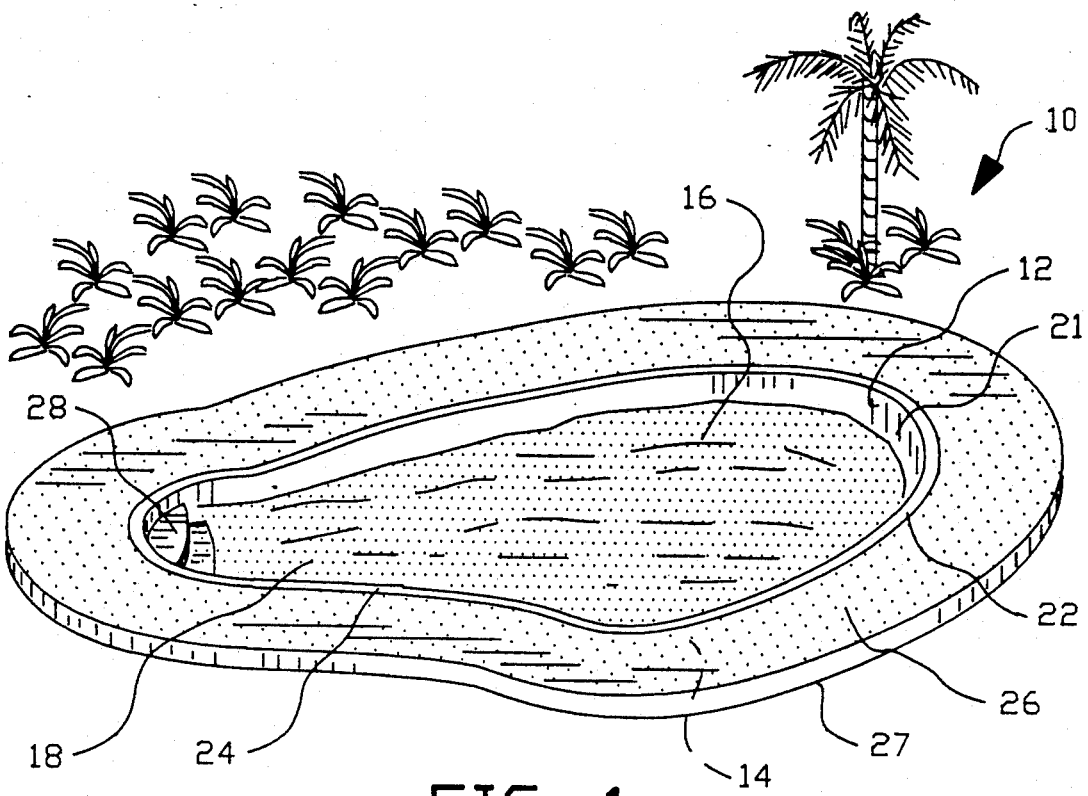
FIG. 1 is an isometric view of an in ground pool made in accordance with the present invention.

FIG. 1 is an isometric view of an in ground pool 10 constructed in accordance with the present invention. The pool 10 includes a sidewall 12 and a base 14 for defining an interior volume 16. The interior volume 16 of the pool 10 receives water 18 in a conventional manner. The sidewall 12 comprises an inner surface 21 and an outer surface 22 for defining a pool perimeter 24. A concrete slab 26 supported by an upper surface of the ground 27 engages with the pool perimeter 24. The pool 10 is shown having interior steps 28 descending from the pool perimeter 24 into the interior volume 16 of the pool 10 for facilitating the entrance and exit from the pool 10.

Figure 2:
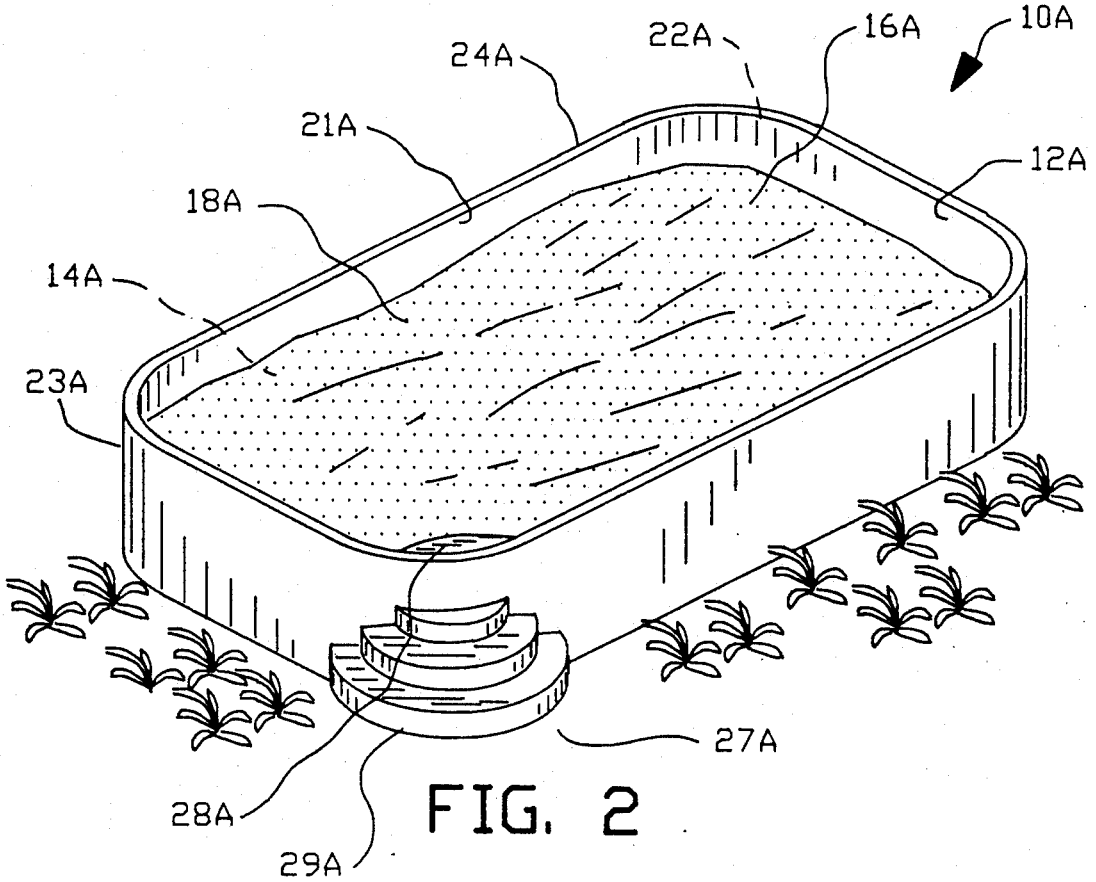
FIG. 2 is an isometric view of an above ground pool made in accordance with the present invention.

FIG. 2 is an isometric view of an above ground pool 10A constructed in accordance with the present invention. The pool 10A includes a sidewall 12A and a base 14A for defining an interior volume 16A. The interior volume 16A of the pool 10A receives water 18A in a conventional manner. The sidewall 12A comprises an inner surface 21A, an outer surface 22A and an optional external surface 23A for defining a pool perimeter 24A. The pool 10A is shown having interior steps 28A descending from the pool perimeter 24A into the interior volume 16A of the pool 10A as well as exterior steps ascending from the an upper surface of the ground 27A to the pool perimeter 24A for facilitating the entrance and exit for the pool 10A.

Figure 3:
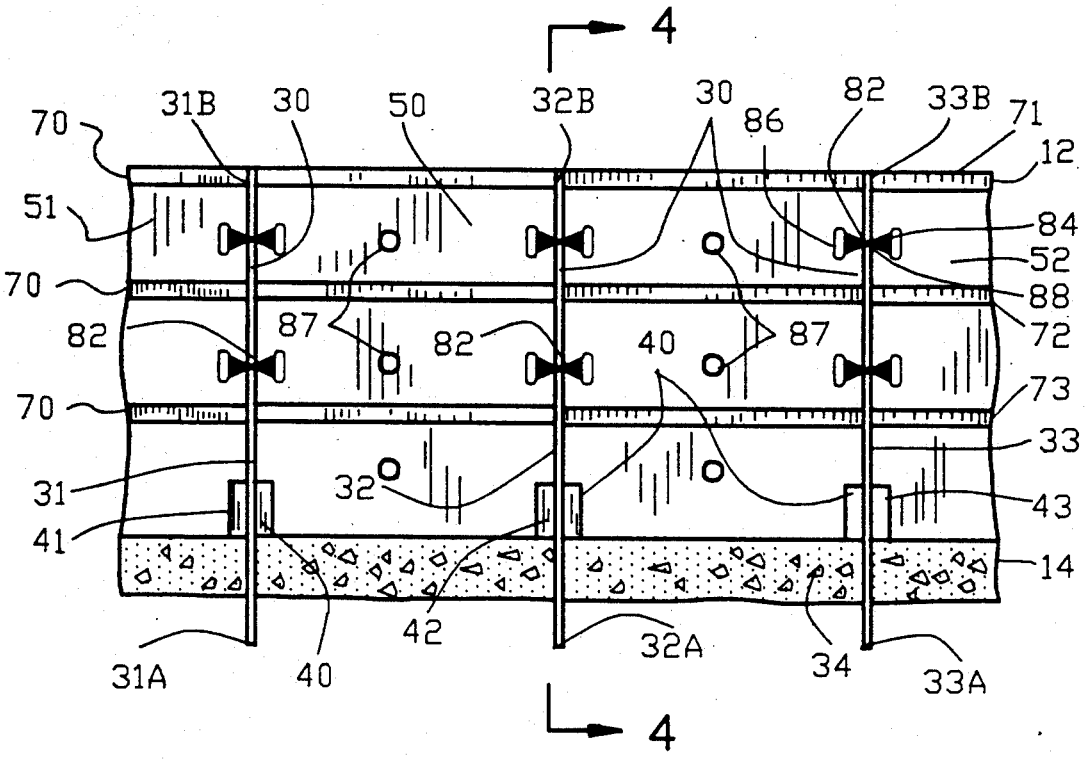
FIG. 3 is an elevational view of a section of an outer surface of the pool of FIG. 1 prior to an inner coating and an outer coating.
Figure 4:
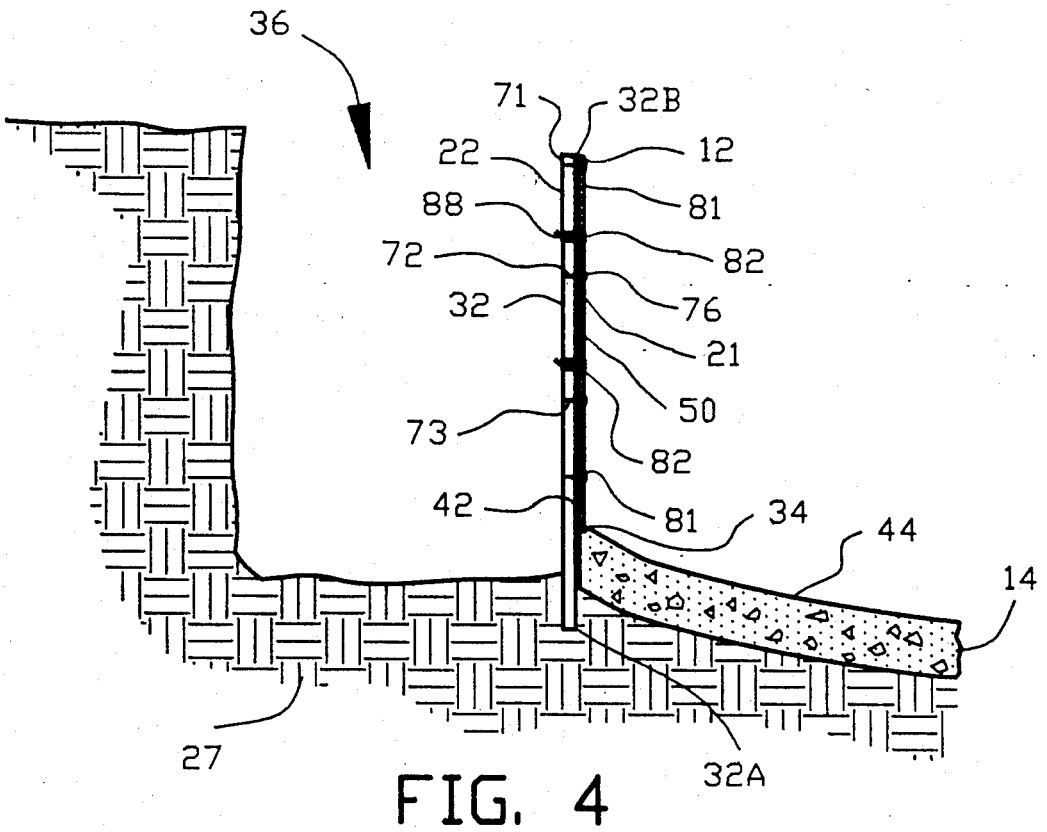
FIG. 4 is a side sectional view along line 4—4 in FIG. 3 prior to the inner coating and the outer coating.
Figure 5:
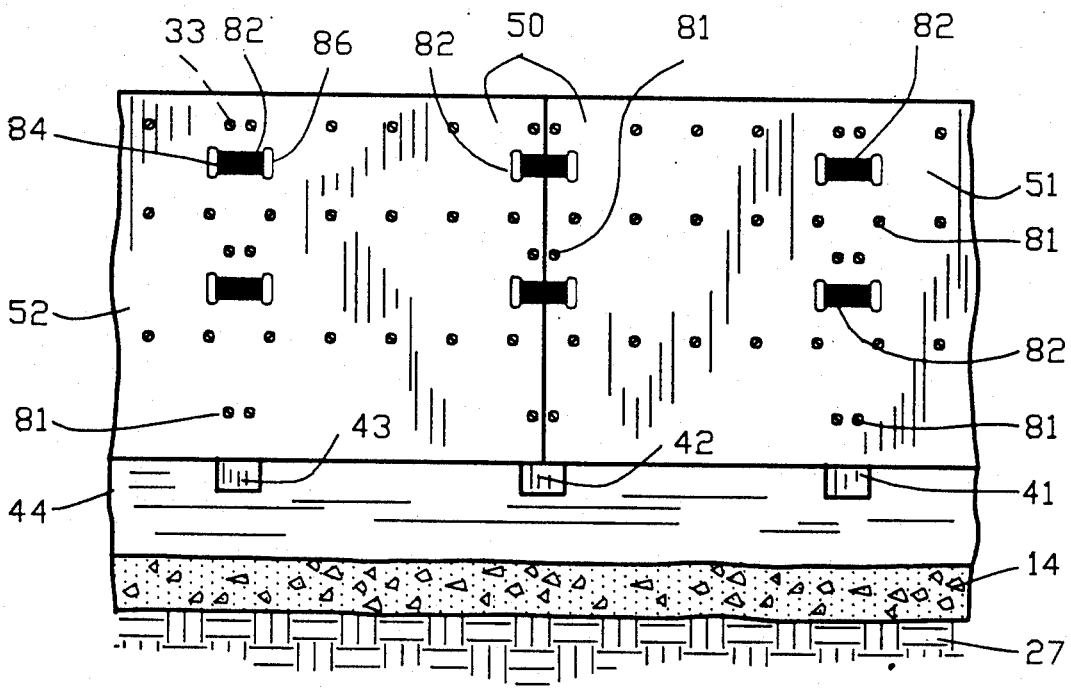
FIG. 5 is an elevational view of a section of an inner surface of the pool of FIG. 1 prior to an application of the inner coating and the outer coating.

Although the pools 10 and 10A of FIGS. 1 and 2 appear to resemble conventional pools, the pools 10 and 10A of the present invention are structurally unique and are constructed in a manner different from the pools heretofore known by the prior art. Furthermore, although the pools 10 and 10A have been shown to be swimming pools of limited size, it should be appreciated by those skilled in the art that the present invention is applicable to swimming pools of unlimited size as well as spa pools and the like. FIG. 3 is an enlarged view illustrating the outer surface 22 of the sidewall 12 of the pool 10 of FIG. 1. FIG. 4 is a sectional view along line 4—4 in FIG. 3 whereas FIG. 5 is an enlarged view illustrating the inner surface 21 of the sidewall 12 of the pool 10 of FIG. 1.

Preferably, the base 14 is constructed of a cementitious material such as concrete and is contoured to form the bottom and partial sidewall of the pool 10 in an excavation. However, it should be understood that various other material may be used for forming the base 14 such as a polymeric material and the like.

Figure 6:
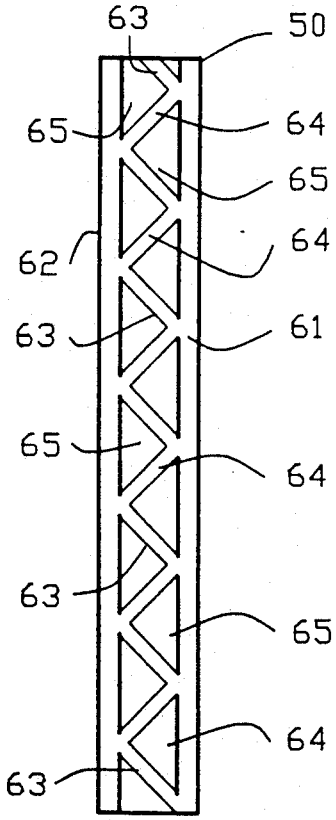
FIG. 6 is an enlarged view of FIG. 4.

As best shown in FIGS. 3, 4 and 6, a plurality of upright supports 30 including a first, a second and a third upright support 31–33 have lower ends 31A–33A thereof extend into the ground 27 adjacent a peripheral edge 34 of the base 14. Preferably, the upright supports 31–33 extend into the ground 27 a distance sufficient that upper ends 31B–33B of the upright supports 31–33 are in a constant height relationship.

The upright supports 30 may be constructed from various materials including wood, metal or polymeric materials. In order to facilitate the construction of the pool 10, a construction trench 36 is shown excavated about the peripheral edge 34 of the base 14.

A plurality of base coupling means 40 including first, second and third base coupling means 41–43 are disposed adjacent to the first, second and third upright members 31–33 and extend over an upper surface 44 of the base 14. Preferably, the base coupling means 40 are constructed of a flexible fiberglass web or fiberglass cloth. The securing of the first, second and third base coupling means 41–43 to the first, second and third upright members 31–33 will be discussed in greater detail hereinafter.

Side wall sheet means 50 including a first and a second side wall sheet 51 and 52 are disposed between the peripheral edge 34 of the base 14 and the plurality of upright supports 30. The first and second sidewall sheets 51 and 52 define the inner surface 21 facing the interior volume 16 of the pool 10 and define the outer surface 22 of the pool 10 facing the exterior of the pool 10.

Preferably, the side wall sheet means 50 is a flexible polymeric material that may be transported in rolls. The side wall sheet means 50 should have a width of one to two meters and a length sufficient to be easily transported in sheets while minimizing the number of seams such as seam 53 between the first and second side wall sheets 51 and 52 as shown in FIG. 5.

Figure 7:
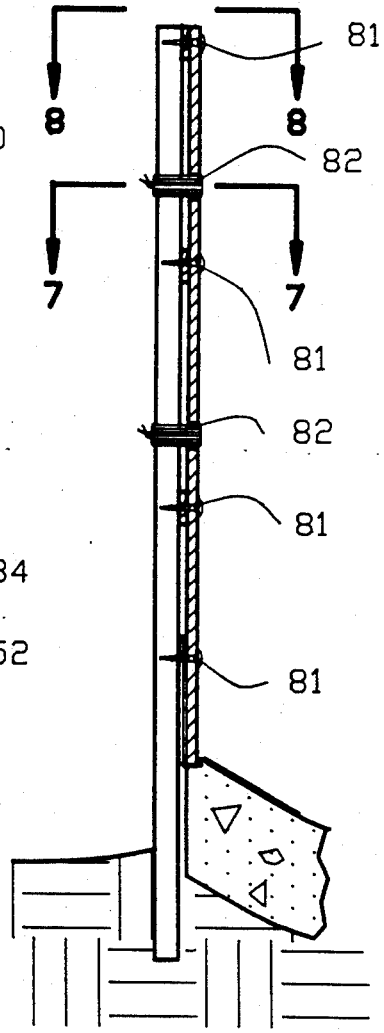
FIG. 7 is an enlarged partial view along line 7—7 in FIG. 6.

FIG. 7 is an enlarged top view along line 7—7 in FIG. 6 illustrating a preferred material for the side wall sheet means 50. The side wall sheet means 50 comprises a sheet of flexible plastic material having an inner sheet 61 and an outer sheet 62 with a plurality of parallel interconnecting sheet elements 63 and 64 securing the inner sheet 61 to the outer sheet 62. The interconnecting sheet elements 63 and 64 are established in a triangular relationship between the inner and outer sheets 61 and 62 for creating triangular voids 65.

The plurality of parallel interconnecting sheet elements 63 and 64 extend in a parallel relationship along the width of the side wall sheet means 50. The triangular relationship of the plurality of parallel interconnecting sheet elements 63 and 64 enable the side wall sheet means 50 to flex in a horizontal direction or flex in a direction along or parallel to the parallel interconnecting sheet elements 63 and 64. Simultaneously therewith, the triangular relationship of the plurality of parallel interconnecting sheet elements 63 and 64 inhibit the side wall sheet means 50 from flexing in a vertical direction or flexing in a direction perpendicular to the parallel interconnecting sheet elements 63 and 64.

The preferred flexing property of the side wall sheet means 50 enables the side wall sheet means 50 to be easily formed for the corners of the pool 10 as shown in FIG. 1. However, the preferred flexing property of the side wall sheet means 50 inhibits the side wall sheet means 50 from expanding outwardly under the hydraulic force produced by the water 18 within the pool 10. Concomitantly therewith, the preferred flexing property of the side wall sheet means 50 inhibits the side wall sheet means 50 from expanding inwardly under the hydraulic force of water within the ground 27 when the water 18 is removed from the pool 10. The triangular voids 65 also provide an air space to add insulation for heated swimming pools or spa pools. Although the side wall sheet means 50 has been described with reference to a preferred material, it should be understood that various types of material may be utilized for the construction of the sidewall sheets means 50 in the present invention.

The present invention includes horizontal support means 70 including an upper horizontal support 71, an intermediate horizontal support 72 and a lower horizontal support 72. The horizontal support means 70 may be temporarily secured to the inner sheet 61 of the side wall sheet means 50 by adhesive means or mechanical fasteners. The horizontal support means 70 are disposed between the side wall sheet means 50 and upright supports 30 as best shown in FIG. 6. Although many types of material can be utilized for the horizontal support means, it has been found the masonite in a thickness of approximately 0.25 inches is suitable for use with the present invention.

Preferably, the horizontal support means 70 are first initially secured to the side wall sheet means 50 by an adhesive and then permanently secured to the side wall sheet means 50 by mechanical fasteners shown as screws 76.

After the horizontal support means 70 have been secured to the side wall sheet means 50, the side wall sheet means 50 is then affixed to the plurality of upright supports 30. The present invention includes affixing means 80 for affixing the side wall sheet means 50 to the plurality of upright supports 30. Specifically, the affixing means 80 includes first affixing means 81 and second affixing means 82.

As best shown in FIGS. 5 and 6, the first affixing means 81 is shown as a plurality of screws extending through the side wall sheet means 50 into the plurality of upright supports 30. In some instances, the screws of the first affixing means 81 extend through the horizontal support means 70 and into the plurality of upright supports 30 creating a space 83 between the side wall sheet means 50 into the plurality of upright supports 30. When the first affixing means 81 extends directly from the side wall sheet means 50 into the plurality of upright supports 30, the first affixing means 81 closes the space 83 between the side wall sheet means 50 into the plurality of upright supports 30.

The base coupling means 40 are inserted in the space 83 between the side wall sheet means 50 and the upright supports 30. The screws of the first affixing means 81 extend through side wall sheet means 50 and through the base coupling means 40 into the upright supports 30 for securing the base coupling means 40.

Figure 8:
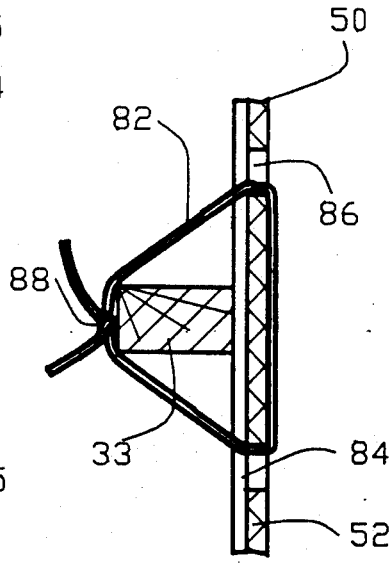
FIG. 8 is an enlarged sectional view along line 8—8 in FIG. 6.

The second affixing means 82 is shown in FIG. 8 as a flexible fiberglass web or fiberglass rope extending through a first and a second hole 84 and 86 in the side wall sheet means 50 and extending about the upright support 32 and secured by suitable means. In this embodiment, the flexible fiberglass web or fiberglass rope is secured by a knot 88. Optionally, a plurality of third holes 87 may be defined throughout the side wall sheet means 50 in a pattern or at random the function of which will become apparent hereinafter.

An important aspect of the present invention is the application of coating means 90 to the sidewall sheet means 50. More specifically, the coating means 90 comprises an inner coating 91 and an outer coating 92. The inner coating 91 provides a liquid tight seal as well as an aesthetic appearance to the inside surface 21 of the pool 10. The outer coating 92 provides mechanical strength to the sidewall sheet means 50.

Figure 9:
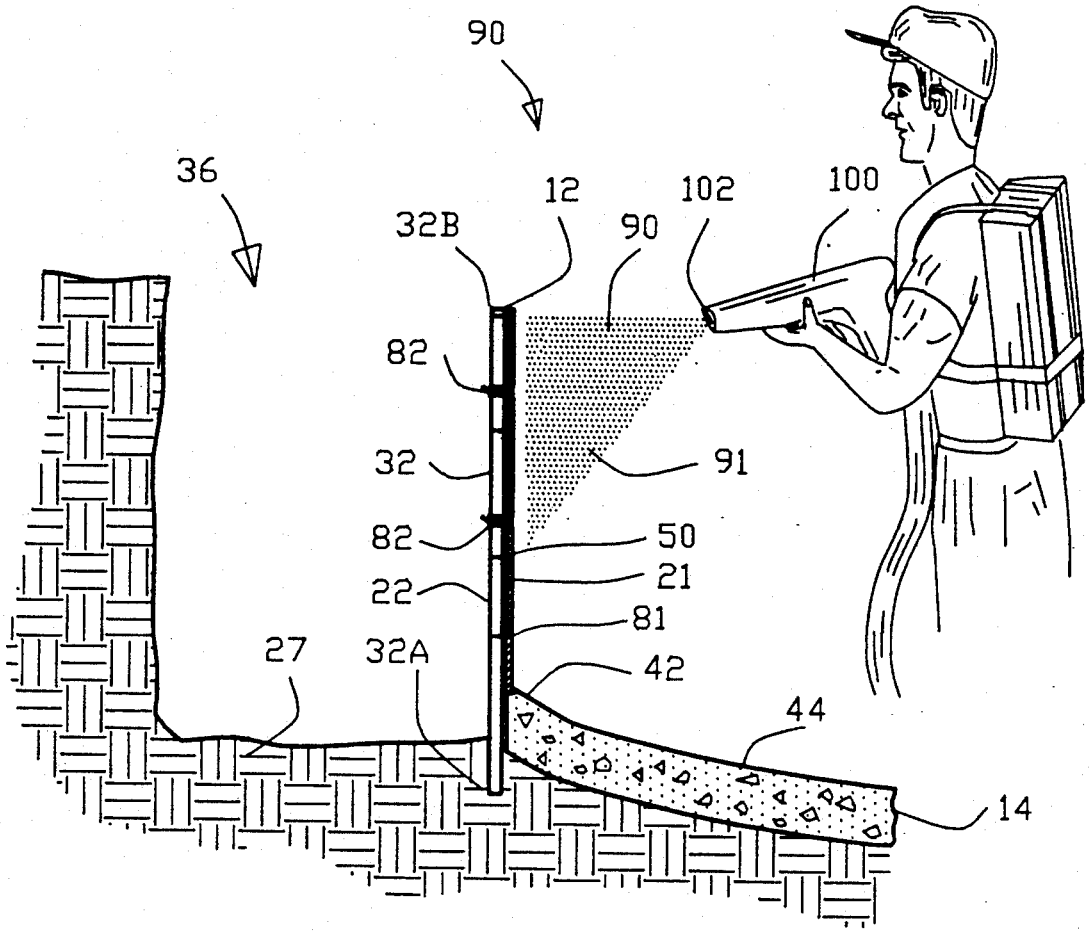
FIG. 9 is a side sectional view similar to FIG. 4 illustrating the spraying of the inner coating on a section of the inner surface of the pool of FIG. 1.

FIG. 9 illustrates the application of the inner coating 91 to the inner surface 21 of the sidewall means 50 as well as to the base 14 through the use of a spray gun 100. Preferably, the inner and outer coatings 91 and 92 are a polymeric resin hardener simultaneously applied with chopped fiberglass strands ejected from a plurality of nozzles 102 of the coating gun 100. The coating gun 100 this type is commonly referred to as a "chopper gun" and is widely used in the industry.

Figure 10:
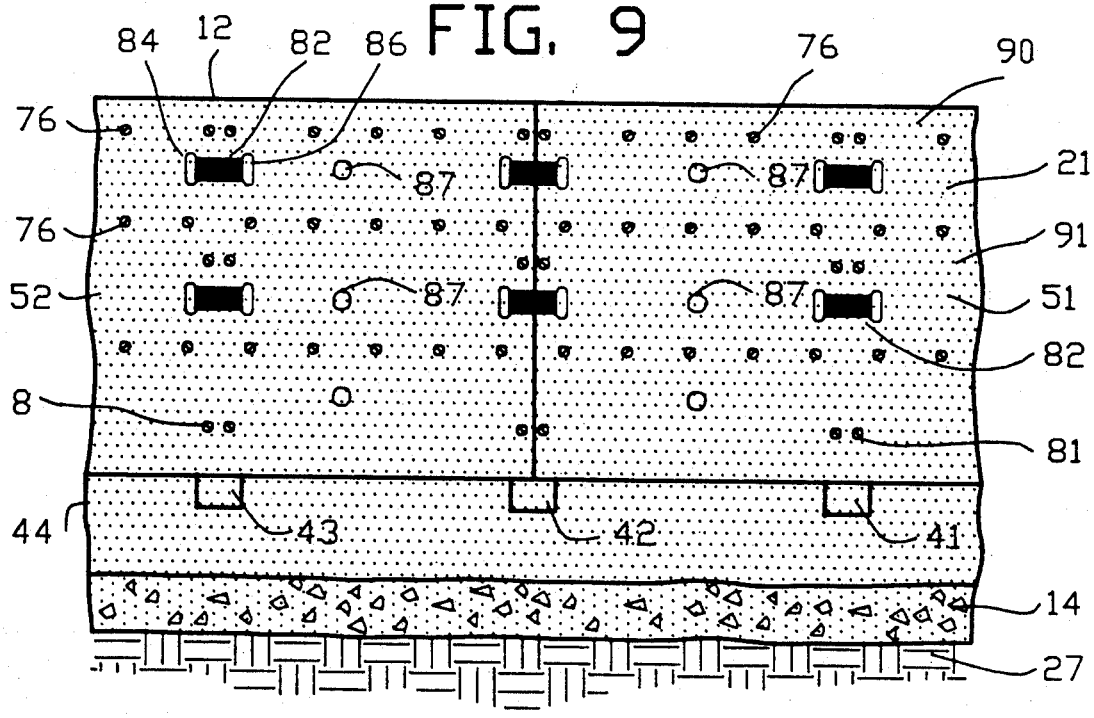
FIG. 10 is an elevational view similar to FIG. 5 illustrating the section of the inner surface of the pool of FIG. 1 with the inner coating.

FIG. 10 illustrates the inner surface 21 of the sidewall sheet means 50 with the inner coating 91 affixed thereto. The inner coating 91 is applied in a thickness sufficient to cover the screws 76 and as well as to cover the first and second affixing means 81 and 82. The inner coating 91 also bonds the base coupling means 40 to the upper surface 44 of base 14. The thickness of the inner coating 91 is of sufficient thickness to cover the base coupling means 40 and provides a smooth contour for the base 14. In addition, the inner coating provides a water tight seal as well as an aesthetic appearance to the interior volume 16 of the pool 10.

Figure 11:
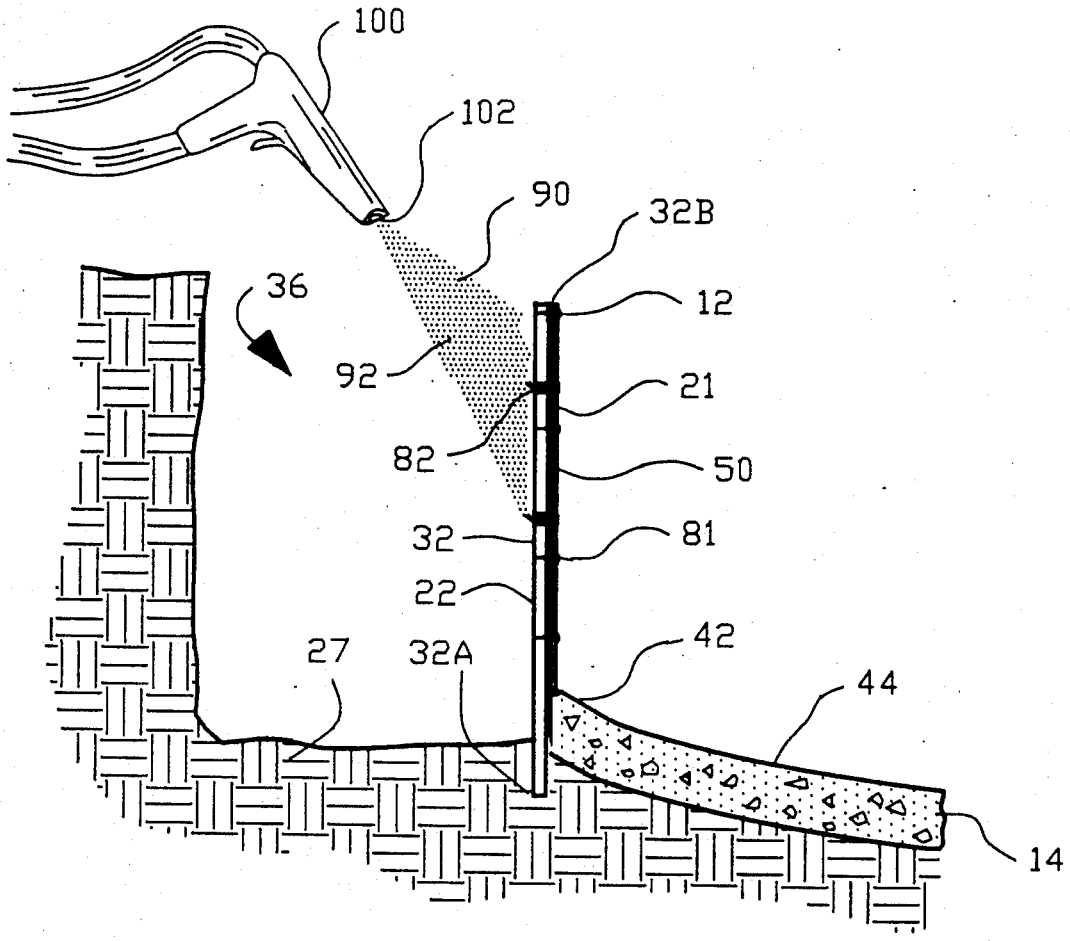
FIG. 11 is a side sectional view similar to FIG. 4 illustrating the spraying of the outer coating on a section of the outer surface of the pool of FIG. 1.
Figure 12:
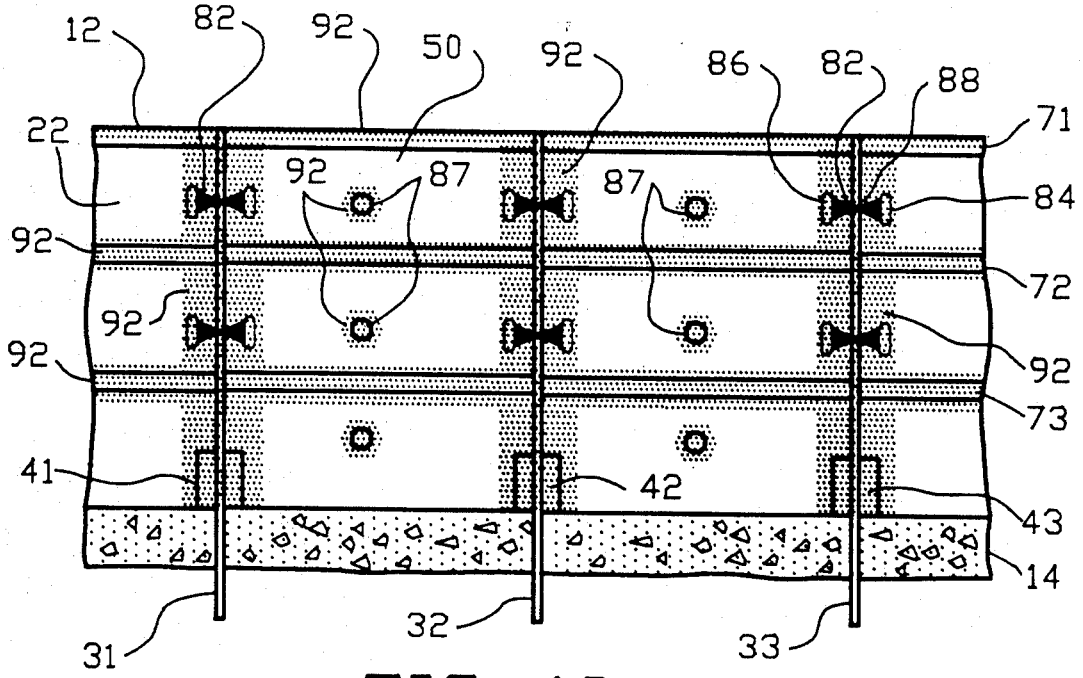
FIG. 12 is an elevational view similar to FIG. 3 illustrating the section of the outer surface of the pool of FIG. 1 with the outer coating.

FIG. 11 illustrates the coating gun 100 applying the outer coating 92 to the outer surface 22. As can be seen from FIG. 12, the outer coating 92 is applied only to selected areas of the outer surface 22. Specifically, the outer coating 92 is applied to the outer surface 22 in proximity to the upright supports 30, the base coupling means 40 and the horizontal support means 70. The outer coating 92 also covers the fiberglass web or cord of the second affixing means 82 as well as the area proximate the third holes 87. The outer coating 92 substantially increases the mechanical strength of the sidewall sheet means 50 to provide superior strength heretofore unknown in the prior art.

Figure 13:
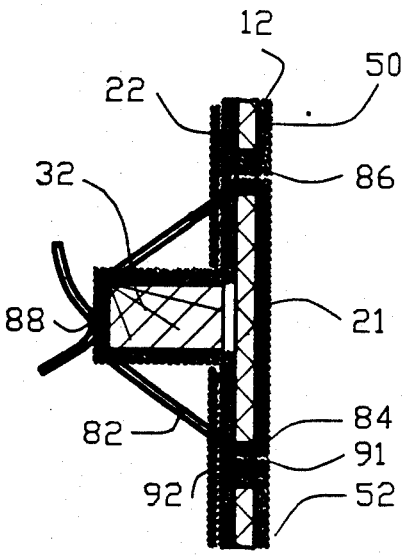
FIG. 13 is a sectional view similar to FIG. 8 illustrating the inner coating and the outer coating.

FIG. 13 is a view similar to FIG. 8 after the application of the inner and outer coatings 91 and 92. The inner coating 92 forms a U-shaped channel about the upright support 32 which functions as a mechanical beam to add mechanical strength to the sidewall sheet means 50. Furthermore, the inner coating 91 is integrally bonded directly to the outer coating 92 through the first and second holes 84 and 86 upon the curing of the inner and outer coatings 91 and 92.

Figure 14:
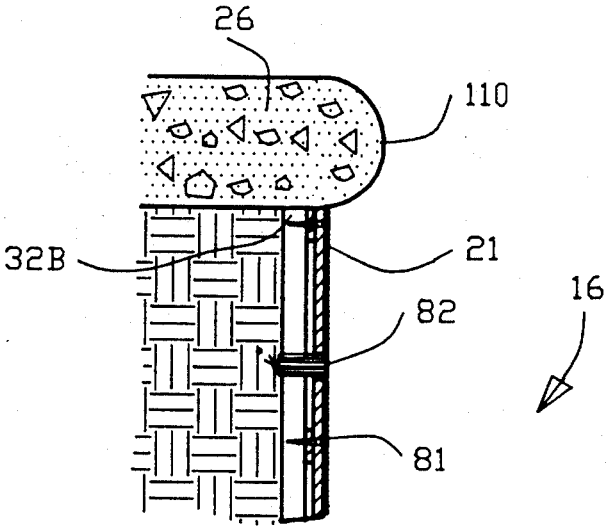
FIG. 14 is an enlarged sectional view illustrating a bonding of the inner coating.
Figure 14:
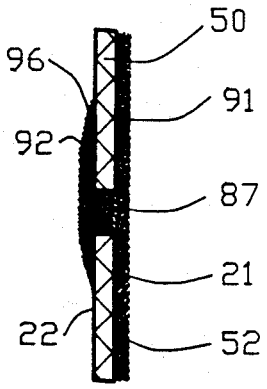

FIG. 14 illustrates the inner coating 91 extending through one of the plurality of the third holes 87. A region 96 of the outer coating 92 has been applied to the outer surface and extends through the third hole 87 to bond directly to the inner coating 91. In many cases, a fiberglass coating does not readily adhere to certain types of polymeric material. Accordingly, the plurality of third holes 87 function to mechanically fasten the inner coating 91 to the sidewall sheet means 50. The region 96 of the outer coating 92 mechanically secures the inner coating 91 to the sidewall sheet means 50 through the third hole 87 to inhibit delamination of the inner coating 91 from the sidewall sheet means 50.

Figure 15:
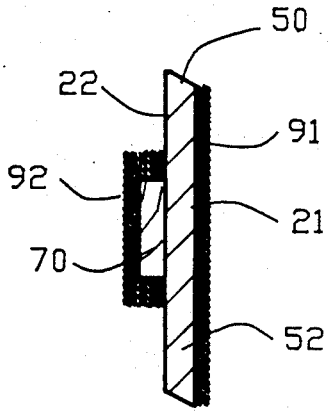
FIG. 15 is an enlarged sectional view illustrating the outer coating covering a horizontal support means.

FIG. 15 illustrates the outer coating 92 forming a U-shaped beam about the horizontal support means 70. This U-shaped beam is similar to the beam shown with reference to FIG. 13. The U-shaped beam formed about the horizontal support means 70 functions as a mechanical beam to add mechanical strength to the sidewall sheet means 50. The U-shaped beams formed by the outer coating 92 provides both vertical and horizontal stability to the sidewall sheet means 50 as well as integrally bonding the outer coating 92 to the inner coating 91.

Figure 16:
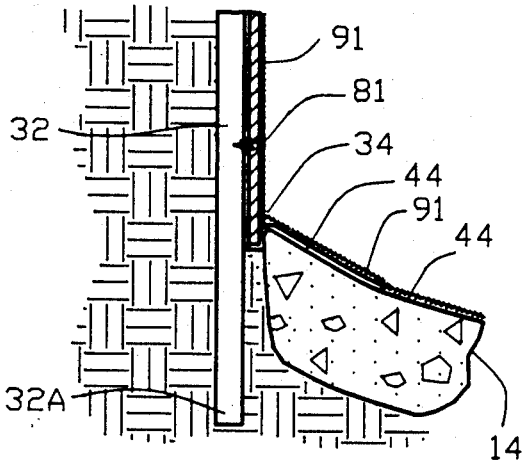
FIG. 16 is an enlarged side sectional view similar to FIGS. 9 and 11 illustrating a slab for forming a lip of the pool.

FIG. 16 illustrates the final completion of the sidewall wherein the trench 36 has been filled with ground soil 27 and the slab 26 has been poured to engage with the sidewall 12. The slab 26 is prepared in a conventional manner with an overhang 110 being constructed through the use of a form (not shown).

Figure 17:
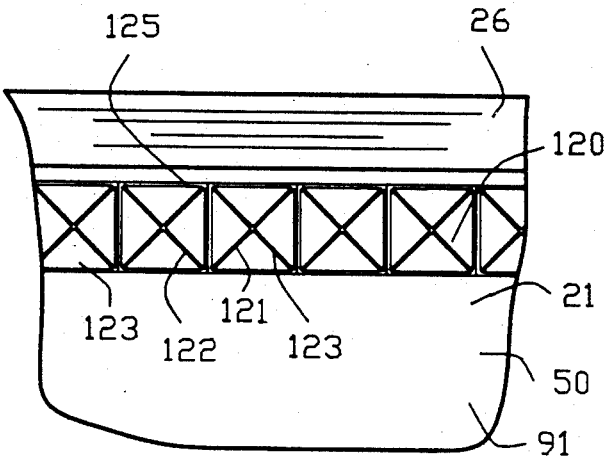
FIG. 17 is an enlarged elevational view of a design on the inner coating.
Figure 18:
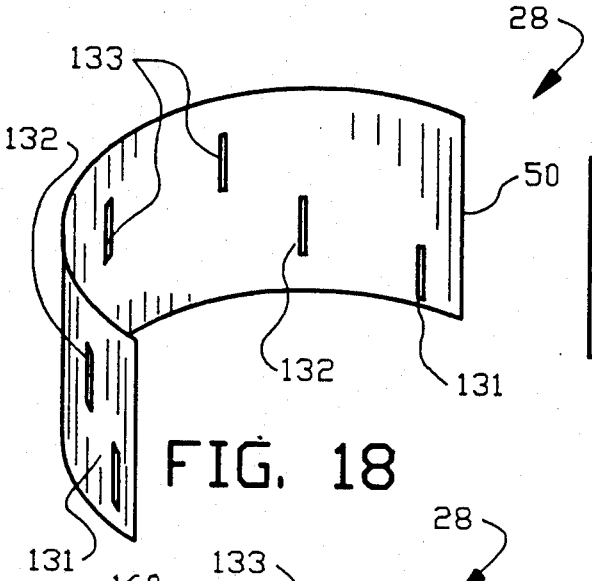
FIG. 18 is an isometric view of a section of the pool of FIG. 1 illustrating slots for forming pool steps.
Figure 19:
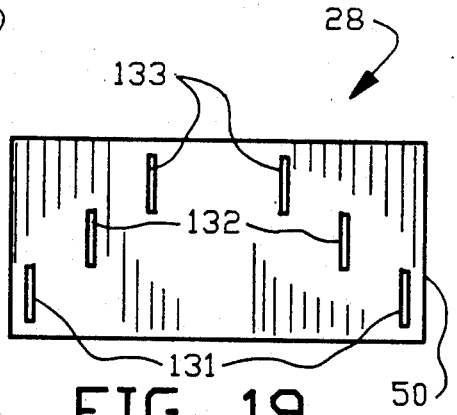
FIG. 19 is a front elevational view of FIG. 18.

FIG. 17 is a front partial view of the inner surface 21 illustrating a decoration 120 applied adjacent the slab 26. This optional decoration 120 may be formed by applying a masking tape (not shown) to the areas 121–125 and painting the decoration 120 thereon. After the paint is dried, the masking tape is removed and the decoration 120 appears as a tile extending about the inner surface 21 of the pool 10 adjacent the slab 26. It should be appreciated that various types and designs of decorations may be applied with the practice of the present invention.

FIGS. 18–23 illustrate the forming of the interior steps 28 of the pool 10. The sidewall 50 is provided with paired slots 131–133 for receiving a plurality of step sidewalls 141–143. The step sidewalls 141–143 are preferably formed of the same material as the sidewall sheet means 50.

Figure 20:
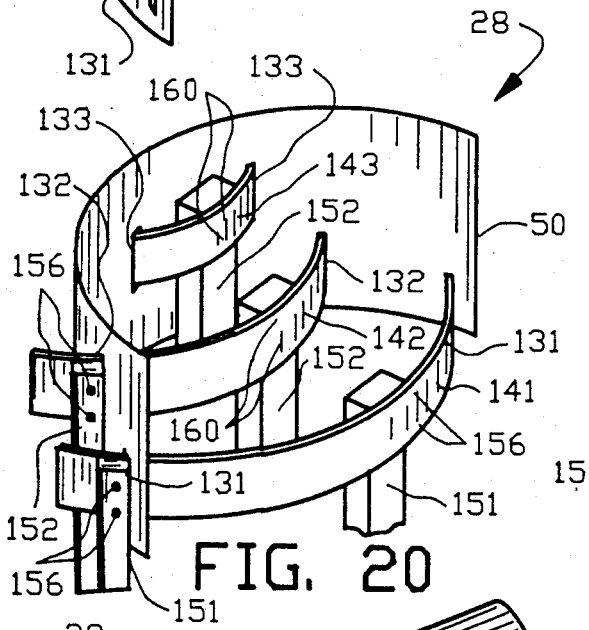
FIG. 20 is an isometric view similar to FIG. 18 illustrating a step side wall sheet extending through the slots for forming pool steps.
Figure 21:
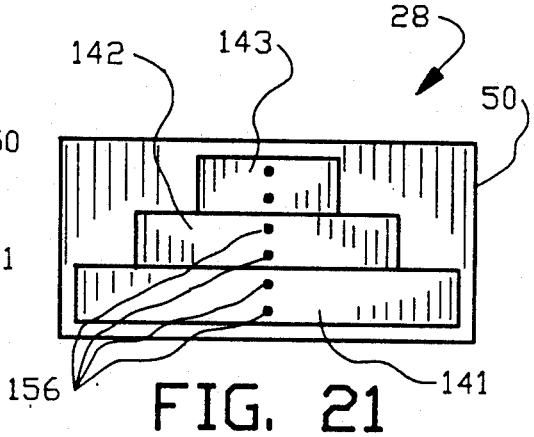
FIG. 21 is a front elevational view of FIG. 20.

FIGS. 20 and 21 illustrate the step sidewalls 141–143 extending through the slots 131–133, respectively, and being supported by a plurality of upright supports 151–153. A plurality of screws 156 affix the step sidewalls 141–143 to the sidewall 50, as well as affixing the step side walls 141–143 to the upright supports 151–153.

Figure 22:
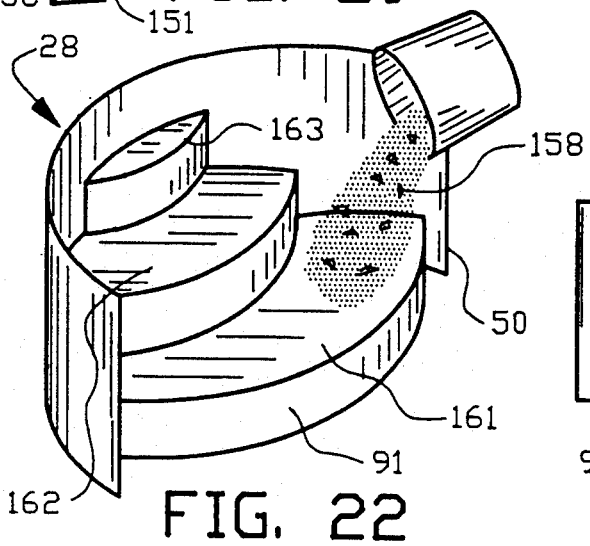
FIG. 22 is an isometric view similar to FIG. 20 illustrating a cementitious material disposed within the step side wall sheet for forming pool steps.
Figure 23:
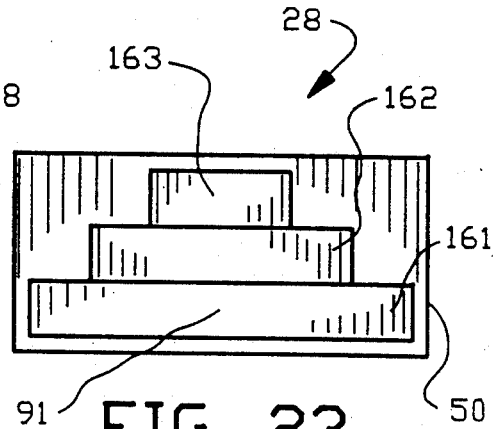
FIG. 23 is a front elevational view of FIG. 22.

FIGS. 22–23 illustrate a cementitious material 158 being introduced within the adjacent step sidewalls 141–143 to form the steps 161–163. The steps 161–163 are then covered by the inner coating 91.

Figure 24:
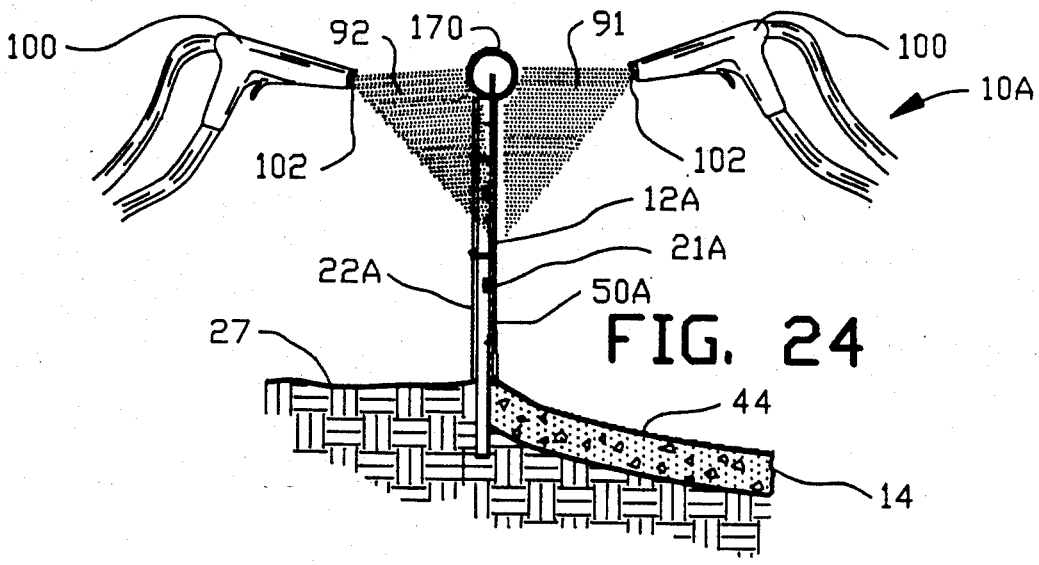
FIG. 24 is a side sectional view of a portion of the above ground pool of FIG. 2 illustrating the spraying of an inner coating and an outer coating.
Figure 25:
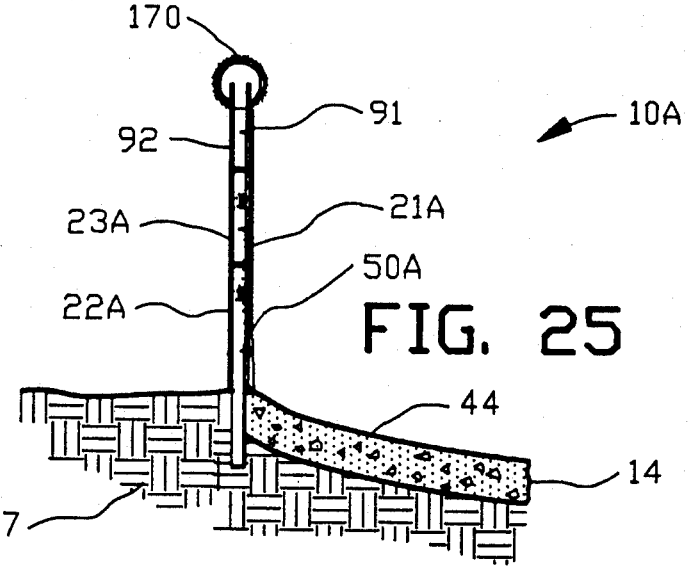
FIG. 25 is a side sectional view similar to FIG. 24 illustrating the securing of an exterior wall sheet.
Figure 26:
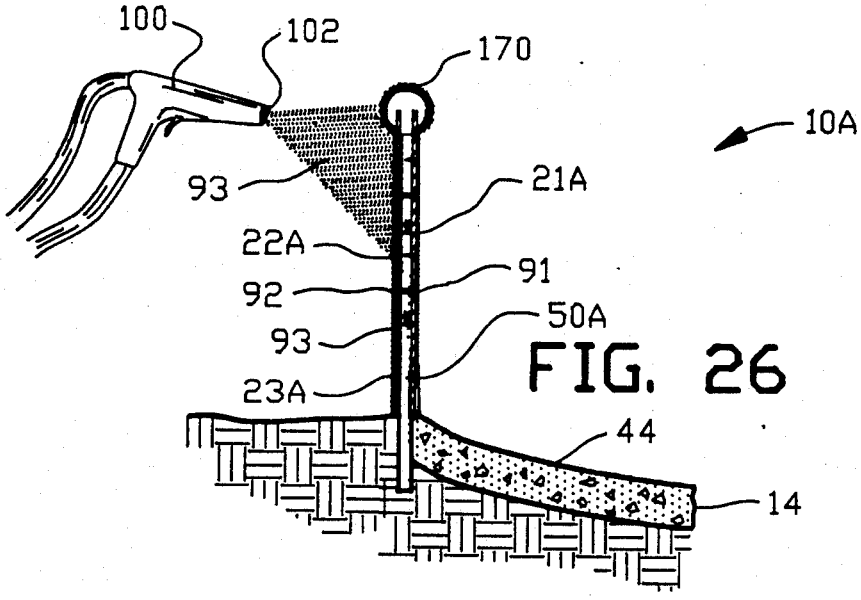
FIG. 26 is a side sectional view similar to FIG. 25 illustrating the spraying of an exterior coating on the exterior wall sheet.

FIGS. 24–26 illustrating a sidewall 12A of the above ground pool illustrated in FIG. 2. The side wall 12A comprises sidewall sheet means 50A erected in a manner identical to the in ground pool 10 set forth with reference to FIGS. 1–23. In this embodiment, a flexible tubing 170 is affixed to the sidewall 12A. The sidewall sheet means 50A is coated with the inner and outer coatings 91 and 92 as set forth in FIG. 22.

FIG. 25 illustrates an external surface sheet 23A being secured to the sidewall sheet means 50A. Preferably, the external surface sheet 23A constructed of the same material as the sidewall sheet means 50 and is mechanically secured by screws to the sidewall sheet means 50A.

FIG. 26 illustrates an external coating 93 being applied to the external surface 23. The use of the external surface 23 and the external coating 93 provides additional mechanical strength to the above ground pool 10A as well as providing an aesthetic appearance to the external surface 23A.

The invention is also incorporated into the method of making a pool comprising installing a plurality of upright supports into the ground. A side wall sheet is affixed to the plurality of upright supports for defining the sidewall of the pool. A fiberglass coating is affixed on an inner surface of the side wall sheet for forming an interior surface for the pool. A fiberglass coating is applied on an outer surface of the side wall sheet for affixing the side wall sheet to the plurality of upright supports.

The present invention enables the construction of either an in ground or an above ground pool of unlimited size and superior mechanical strength. As it can be appreciated by those skilled in the art, the pool constructed in accordance with the present invention may be installed in locations with limited access which was heretofore unavailable in the prior art. The costs of pools constructed by the present invention is substantially less than pools constructed by conventional processes. A typical residential swimming pool can be completely finished and filled with water within a 7–10 day period of time.

It has been found that the side wall 12 of the in ground pool 10 is sufficient in strength to support the adjacent ground 27 without any water 18 being disposed in the pool 10. Accordingly, the trench 36 need not be filled concomitantly with the filling of water 18 into the pool 10 as required by the prior art practices. Accordingly, the pool 10 may be thoroughly cleaned after complete construction of the pool 10 and prior to filling with water 18. It has also been found that the side wall 12A of the above ground pool 10A show no observable deflection when filled with water 18A.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A swimming pool apparatus, comprising:

a base extending within a peripheral edge;

said base being contoured to form the bottom of the pool;

a plurality of upright supports disposed adjacent said peripheral edge of said base;

a side wall sheet extending about said peripheral edge of said base;

said side wall sheet being disposed between said peripheral edge of said base and said plurality of upright supports;

said side wall sheet having an inner surface facing an interior of the pool and an outer surface facing an exterior of the pool;

means for affixing said side wall sheet to said plurality of upright supports;

an inner coating disposed on said inner surface of said side wall sheet and disposed on said base for affixing said side wall sheet to said base and for forming an interior surface for the pool; and an outer coating disposed on said outer surface of said side wall sheet for affixing said side wall sheet to said plurality of upright supports.

2. A swimming pool apparatus as set forth in claim 1, wherein said base comprises a cementitious material.

3. A swimming pool apparatus as set forth in claim 1, wherein said base is supported by ground soil; and said plurality of upright supports extend into said ground soil.

4. A swimming pool apparatus as set forth in claim 1, wherein said side wall sheet comprises a sheet of flexible plastic material.

5. A swimming pool apparatus as set forth in claim 1, wherein said side wall sheet comprises a sheet of flexible plastic material;

said sheet of plastic material comprising an inner sheet and an outer sheet with a plurality of parallel interconnecting sheet elements securing said inner sheet to said outer sheet; and said plurality of parallel interconnecting sheet elements enabling said sheet of flexible plastic material to flex in a horizontal direction and for inhibiting said sheet of flexible plastic material to flex in a vertical direction.

6. A swimming pool apparatus as set forth in claim 1, wherein said side wall sheet comprises a sheet of flexible plastic material;

said sheet of plastic material comprising an inner sheet and an outer sheet with a plurality of parallel interconnecting sheet elements securing said inner sheet to said outer sheet; and said plurality of parallel interconnecting sheet elements being arranged in a triangular relationship for enabling said sheet of flexible plastic material to flex in a horizontal direction and for inhibiting said sheet of flexible plastic material to flex in a vertical direction.

7. A swimming pool apparatus as set forth in claim 1, wherein said means for affixing said side wall sheet to said plurality of upright supports includes fastening means extending through a plurality of apertures defined in said side wall sheet.

8. A swimming pool apparatus as set forth in claim 1, wherein said inner coating and said outer coating comprises a coating of fiberglass.

9. A swimming pool apparatus as set forth in claim 1, including a plurality of apertures defined in said side wall sheet; and said inner coating and said outer coating being joined to one another through said plurality of apertures for mechanically securing said inner coating to said side wall sheet.

10. A swimming pool apparatus, comprising:

a cementitious base extending within a peripheral edge;

said cementitious base being contoured to form the bottom of the pool;

a plurality of upright supports disposed adjacent said peripheral edge of said cementitious base;

a side wall sheet extending about said peripheral edge of said cementitious base;

said side wall sheet being disposed between said peripheral edge of said cementitious base and said plurality of upright supports;

said side wall sheet having an inner surface facing an interior of the pool and an outer surface facing an exterior of the pool;

a plurality of apertures defined in said side wall sheet;

means for affixing said side wall sheet to said plurality of upright supports;

an inner coating of fiberglass disposed on said inner surface of said side wall sheet and disposed on said cementitious base for affixing said side wall sheet to said cementitious base and for forming an interior surface for the pool;

an outer coating of fiberglass disposed on said outer surface of said side wall sheet for affixing said side wall sheet to said plurality of upright supports; and said inner coating of fiberglass and said outer coating of fiberglass being joined to another through said plurality of apertures for mechanically securing said inner coating of fiberglass to said side wall sheet.

11. A swimming pool apparatus as set forth in claim 10, wherein said base is supported by ground soil; and a plurality of upright supports extend into said ground soil.

12. A swimming pool apparatus as set forth in claim 10, wherein said side wall sheet comprises a sheet of flexible plastic material.

13. A swimming pool apparatus as set forth in claim 10, wherein said side wall sheet comprises a sheet of flexible plastic material;

said sheet of plastic material comprising an inner sheet and an outer sheet with a plurality of parallel interconnecting sheet elements securing said inner sheet to said outer sheet; and said plurality of parallel interconnecting sheet elements enabling said sheet of flexible plastic material to flex in a horizontal direction and for inhibiting said sheet of flexible plastic material to flex in a vertical direction.

14. A swimming pool apparatus as set forth in claim 10, wherein said side wall sheet comprises a sheet of flexible plastic material;

said sheet of plastic material comprising an inner sheet and an outer sheet with a plurality of parallel interconnecting sheet elements securing said inner sheet to said outer sheet; and said plurality of parallel interconnecting sheet elements being arranged in a triangular relationship for enabling said sheet of flexible plastic material to flex in a horizontal direction and for inhibiting said sheet of flexible plastic material to flex in a vertical direction.

15. A swimming pool apparatus as set forth in claim 10, wherein said means for affixing said side wall sheet to said plurality of upright supports includes fastening means extending through a plurality of apertures defined in said side wall sheet.

16. The method of making an in ground swimming pool, comprising the steps of:

excavating a hole in the ground in the shape and the depth of the desired pool;

installing plurality of upright supports into the ground about the periphery of the excavated hole;

affixing a side wall sheet to the plurality of upright supports for defining the sidewall of the pool;

pouring a cementitious base within the side wall sheet to form the bottom of the pool;

applying a fiberglass coating on an inner surface of the side wall sheet and on the cementitious base for affixing the side wall sheet to the cementitious base and for forming an interior surface for the pool; and applying a fiberglass coating on an outer surface of the side wall sheet for affixing the side wall sheet to the plurality of upright supports.

17. The method of making an in ground swimming pool as set forth in claim 16, wherein the step of affixing the side wall sheet to the plurality of upright supports includes installing fasteners to extend through a plurality of apertures defined in the side wall sheet.

18. The method of making an in ground swimming pool as set forth in claim 16 wherein the step of applying a fiberglass coating on an inner surface and on the outer surface of the side wall sheet includes affixing the fiberglass coating on the inner surface of the side wall sheet to the fiberglass coating on the outer surface of the side wall sheet through a plurality of apertures in the side wall sheet for mechanically securing the inner coating of fiberglass to the side wall sheet.

* * * * *